US006428386B1

(12) United States Patent
Bartlett

(10) Patent No.: US 6,428,386 B1
(45) Date of Patent: Aug. 6, 2002

(54) PLANARIZING PADS, PLANARIZING MACHINES, AND METHODS FOR MECHANICAL AND/OR CHEMICAL-MECHANICAL PLANARIZATION OF MICROELECTRONIC-DEVICE SUBSTRATE ASSEMBLIES

(75) Inventor: Aaron T. Bartlett, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/595,727

(22) Filed: Jun. 16, 2000

(51) Int. Cl.[7] ..... B24B 1/00

(52) U.S. Cl. ..... 451/6; 451/41; 451/287

(58) Field of Search ..... 451/6, 7, 285, 451/286, 287, 288, 289, 526, 41; 156/345

(56) References Cited

U.S. PATENT DOCUMENTS

| | | | |
|---|---|---|---|
| 4,200,395 | A | 4/1980 | Smith et al. |
| 4,203,799 | A | 5/1980 | Sugawara et al. |
| 4,358,338 | A | 11/1982 | Downey et al. |
| 4,367,044 | A | 1/1983 | Booth Jr. et al. |
| 4,377,028 | A | 3/1983 | Imahashi |
| 4,422,764 | A | 12/1983 | Eastman |
| 4,640,002 | A | 2/1987 | Phillips et al. |
| 4,660,980 | A | 4/1987 | Takabayashi et al. |
| 4,717,255 | A | 1/1988 | Ulbers |
| 4,879,258 | A | 11/1989 | Fisher |

(List continued on next page.)

FOREIGN PATENT DOCUMENTS

EP 0 623 423 A1 11/1994

OTHER PUBLICATIONS

U.S. patent application No. 09/589,380 (Atty Docket No. 108298504US), Agarwal, filed Jun. 7, 2000.
U.S. patent application No. 09/651,240 (Atty. Docket No. 1082998522US), Moore, filed Aug. 30, 2000.
U.S. patent application No. 09/651,417 (Atty Docket No. 108298534US), Moore, filed Aug. 30, 2000.

(List continued on next page.)

*Primary Examiner*—Joseph J. Hail, III
*Assistant Examiner*—Hadi Shakeri
(74) *Attorney, Agent, or Firm*—Perkins Coie LLP

(57) ABSTRACT

A planarizing pad having a leak resistant optical system to provide an optical path through the pad and to inhibit or prevent planarizing solution from leaking through the pad. In one embodiment of a planarizing machine, the machine includes a table having a support surface and an optical monitoring system coupled to the table. The optical monitoring system can have a light source and an optical sensor aligned with an opening in the table to direct and detect a light beam through the opening. The planarizing machine can further include a planarizing pad coupled to the support surface of the table. The planarizing pad comprises a planarizing medium, an optically transmissive window in the planarizing medium, and a backing member attached to the planarizing medium. The planarizing medium can have a planarizing surface, a backside opposite the planarizing surface, and at least one hole extending from the planarizing surface to the backside. The backing member has a top surface attached to the backside of the planarizing medium and an exposed section extending from the sidewall to either (a) span completely across the hole or (b) project across a portion of the hole for a cover distance that is measured normal to the sidewall. The optically transmissive window is positioned in the hole, and it has an interface surface the exposed section along a seal path that either spans completely across the hole or has a length greater than the cover distance.

62 Claims, 5 Drawing Sheets

U.S. PATENT DOCUMENTS

| | | | | | |
|---|---|---|---|---|---|
| 5,036,015 | A | | 7/1991 | Sandhu et al. | |
| 5,081,796 | A | | 1/1992 | Schultz | |
| 5,220,405 | A | | 6/1993 | Barbee et al. | |
| 5,324,381 | A | | 6/1994 | Nishiguchi | |
| 5,369,488 | A | | 11/1994 | Morokuma | |
| 5,393,624 | A | | 2/1995 | Ushijima | |
| 5,413,941 | A | | 5/1995 | Koos et al. | |
| 5,433,651 | A | * | 7/1995 | Lustig et al. | 451/6 |
| 5,461,007 | A | | 10/1995 | Kobayashi | |
| 5,465,154 | A | | 11/1995 | Levy | |
| 5,609,718 | A | | 3/1997 | Meikle | |
| 5,624,303 | A | | 4/1997 | Robinson | |
| 5,645,471 | A | | 7/1997 | Strecker | |
| 5,667,424 | A | | 9/1997 | Pan | |
| 5,738,562 | A | | 4/1998 | Doan et al. | |
| 5,777,739 | A | | 7/1998 | Sandhu et al. | |
| 5,791,969 | A | | 8/1998 | Lund | |
| 5,865,665 | A | | 2/1999 | Yueh | |
| 5,879,222 | A | | 3/1999 | Robinson | |
| 5,893,796 | A | | 4/1999 | Birang et al. | |
| 5,899,792 | A | | 5/1999 | Yagi | |
| 5,934,974 | A | | 8/1999 | Tzeng | |
| 5,949,927 | A | * | 9/1999 | Tang | 451/6 |
| 5,997,384 | A | | 12/1999 | Blalock | |
| 6,000,996 | A | | 12/1999 | Fujiwara | |
| 6,039,633 | A | | 3/2000 | Chopra | |
| 6,045,439 | A | * | 4/2000 | Birang et al. | 451/6 |
| 6,068,539 | A | | 5/2000 | Bajaj et al. | |
| 6,075,606 | A | | 6/2000 | Doan | |
| 6,102,775 | A | | 8/2000 | Ushio et al. | |
| 6,108,091 | A | * | 8/2000 | Pecen et al. | 451/6 |
| 6,108,092 | A | * | 8/2000 | Sandhu | 451/6 |
| 6,139,402 | A | | 10/2000 | Moore | |
| 6,213,845 | B1 | | 4/2001 | Elledge | |
| 6,247,998 | B1 | | 6/2001 | Wiswesser et al. | |
| 6,301,006 | B1 | | 10/2001 | Doan | |

OTHER PUBLICATIONS

Applied Materials, Inc. 2002, "Mira Mesa Advanced Integrated CMP," Applied Materials. Products. CMP. Mirra Mesa CMP, (2 pages).

Applied Materials, Inc., 2002, "About the CMP Process, " Applied Materials. Products. CMP. About the CMP Process, (1 page).

PCT International Search Report for International Application No. PCT/US99/09016, Aug. 18, 1999, (4 pages).

* cited by examiner

PLANARIZING PADS, PLANARIZING MACHINES, AND METHODS FOR MECHANICAL AND/OR CHEMICAL-MECHANICAL PLANARIZATION OF MICROELECTRONIC-DEVICE SUBSTRATE ASSEMBLIES

TECHNICAL FIELD

The present invention is directed toward mechanical and/or chemical-mechanical planarization of microelectronic-device substrate assemblies. More specifically, the invention is related to planarizing pads, planarizing machines and methods for optically monitoring the status of a microelectronic-device substrate assembly during a planarizing cycle.

BACKGROUND OF THE INVENTION

Mechanical and chemical-mechanical planarizing processes (collectively "CMP") remove material from the surface of semiconductor wafers, field emission displays or other microelectronic substrates in the production of microelectronic devices and other products. FIG. 1 schematically illustrates a rotary CMP machine 10 with a platen 20, a carrier assembly 30, and a planarizing pad 40. The CMP machine 10 may also have an under-pad 25 attached to an upper surface 22 of the platen 20 and the lower surface of the planarizing pad 40. A drive assembly 26 rotates the platen 20 (indicated by arrow F), or it reciprocates the platen 20 back and forth (indicated by arrow G). Since the planarizing pad 40 is attached to the under-pad 25, the planarizing pad 40 moves with the platen 20 during planarization.

The carrier assembly 30 has a head 32 to which a substrate 12 may be attached, or the substrate 12 may be attached to a resilient pad 34 positioned between the substrate 12 and the head 32. The head 32 may be a free-floating wafer carrier, or the head 32 may be coupled to an actuator assembly 36 that imparts axial and/or rotational motion to the substrate 12 (indicated by arrows H and I, respectively).

The planarizing pad 40 and the planarizing solution 44 define a planarizing medium that mechanically and/or chemically-mechanically removes material from the surface of the substrate The planarizing pad 40 can be a fixed-abrasive planarizing pad in which abrasive particles are fixedly bonded to a suspension material. In fixed-abrasive applications, the planarizing solution is typically a non-abrasive "clean solution" without abrasive particles. In other applications, the planarizing pad 40 can be a non-abrasive pad composed of a polymeric material (e.g., polyurethane), resin, felt or other suitable non-abrasive materials. The planarizing solutions 44 used with the non-abrasive planarizing pads are typically abrasive slurries with abrasive particles suspended in a liquid.

To planarize the substrate 12 with the CMP machine 10, the carrier assembly 30 presses the substrate 12 face-downward against the polishing medium. More specifically, the carrier assembly 30 generally presses the substrate 12 against the planarizing liquid 44 on the planarizing surface 42 of the planarizing pad 40, and the platen 20 and/or the carrier assembly 30 move to rub the substrate 12 against the planarizing surface 42. As the substrate 12 rubs against the planarizing surface 42, material is removed from the face of the substrate 12.

CMP processes should consistently and accurately produce a uniformly planar surface on the substrate to enable precise fabrication of circuits and photo-patterns. During the construction of transistors, contacts, interconnects and other features, many substrates develop large "step heights" that create highly topographic surfaces. Such highly topographical surfaces can impair the accuracy of subsequent photolithographic procedures and other processes that are necessary for forming sub-micron features. For example, it is difficult to accurately focus photo patterns to within tolerances approaching 0.1 micron on topographic surfaces because sub-micron photolithographic equipment generally has a very limited depth of field. Thus, CMP processes are often used to transform a topographical surface into a highly uniform, planar surface at various stages of manufacturing microelectronic devices on a substrate.

In the highly competitive semiconductor industry, it is also desirable to maximize the throughput of CMP processing by producing a planar surface on a substrate as quickly as possible. The throughput of CMP processing is a function, at least in part, of the ability to accurately stop CMP processing at a desired endpoint. In a typical CMP process, the desired endpoint is reached when the surface of the substrate is planar and/or when enough material has been removed from the substrate to form discrete components on the substrate (e.g., shallow trench isolation areas, contacts and damascene lines). Accurately stopping CMP processing at a desired endpoint is important for maintaining a high throughput because the substrate assembly may need to be re-polished if it is "under-planarized," or components on the substrate may be destroyed if it is "over-polished." Thus, it is highly desirable to stop CMP processing at the desired endpoint.

In one conventional method for determining the endpoint of CMP processing, the planarizing period of a particular substrate is determined using an estimated polishing rate based upon the polishing rate of identical substrates that were planarized under the same conditions. The estimated planarizing period for a particular substrate, however, may not be accurate because the polishing rate or other variables may change from one sabstrate to another. Thus, this method may not produce accurate results.

In another method for determining the endpoint of CMP processing, the substrate is removed from the pad and then a measuring device measures a change in thickness of the substrate. Removing the substrate from the pad, however, interrupts the planarizing process and may damage the substrate. Thus, this method generally reduces the throughput of CMP processing.

U.S. Pat. No. 5,433,651 issued to Lustig et al. ("Lustig") discloses an in-situ chemical-mechanical polishing machine for monitoring the polishing process during a planarizing cycle. The polishing machine has a rotatable polishing table including a window embedded in the table. A planarizing pad is attached to the table, and the pad has an aperture aligned with the window in the table. The window is positioned at a location over which the workpiece can pass for in-situ viewing of a polishing surface of the workpiece from beneath the polishing table. The planarizing machine also includes a device for measuring a reflectance signal representative of an in-situ reflectance of the polishing surface of the workpiece. One drawback of the device disclosed in Lustig is that slurry may seep under the pad adjacent to the aperture. The slurry may accordingly contaminate the backside of the pad or the platen in a manner that affects the consistency of the planarizing process, reduces the life of the pad, and increases maintenance for cleaning.

Another oral endpointing system is a component of the Mirra® planarizing machine manufactured by Applied Material Corporation of California. The Mirra® machine has a rotary platen with an optical emitter/sensor and a planarizing pad with a window over the optical emitter/sensor. Although the Mirra® machine is an improvement over many other endpointing systems, the planarizing solution can leak through the interface between the pad and the window. The Mirra® machine, therefore, may also produce inconsistent results, require more maintenance because the backside of the pad and the platen may be contaminated, and reduce the life of the pad because the abrasive particles can wear away the backside of the pad.

SUMMARY OF THE INVENTION

The present invention is directed toward planarizing pads, planarizing machines and methods for manufacturing and using planarizing pads in mechanical and/or chemical-mechanical planarization of microelectronic-device substrate assemblies. In one embodiment of a planarizing machine, the machine includes a table having a support surface and an optical monitoring system coupled to the table. The table, for example, can be a rotary platen or a stationary support surface having an opening at an illumination site. The optical monitoring system can have a light source and an optical sensor aligned with the opening in the table to direct and detect a light beam through the opening.

The planarizing machine can further include a planarizing pad coupled to the support surface of the table. The planarizing pad comprises a planarizing medium, an optically transmissive window in the planarizing medium, and a backing member attached to the planarizing medium. The planarizing medium can have a planarizing surface, a backside opposite the planarizing surface, and at least one hole extending from the planarizing surface to the backside. The hole in the planarizing medium generally has a sidewall transverse to the backside. The backing member has a top surface attached to the backside of the planarizing medium and an exposed section extending from the sidewall to either (a) span completely across the hole or (b) project across a portion of the hole for a cover distance that is measured normal to the sidewall. The optically transmissive window is positioned in the hole, and it has an interface surface contacting the exposed section o backing member. The interface surface of the window generally contacts the exposed section along a seal path that either spans completely across the hole or extends along a length greater than the cover distance.

The planarizing machine can further include a carrier assembly having a head and a drive mechanism. In operation, a planarizing solution is disposed on the planarizing surface of the planarizing medium, and then either the head of the carrier system and/or the planarizing pad move in a planarizing plane to rub the substrate against the planarizing medium. The optically transmissive window and the backing member are configured to inhibit or eliminate the planarizing solution from leaking through the planarizing pad. Additionally, the optically transmissive window and the backing member are generally discrete components comprising different materials to take advantage of particular optical, and planarizing properties of the window and to also take advantage of the durability and other properties of the backing member.

BRIEF DESCRIPTION OF THE DRAWINGS

As FIG. 1 is a schematic cross-sectional view of a rotary planarizing machine in accordance with the prior art.

DETAILED DESCRIPTION

The present invention is directed toward planarizing pads, planarizing machines, and methods for optically monitoring mechanical and/or chemical-mechanical planarization of microelectronic-device substrates. The terms "substrate" and "substrate assembly" include semiconductor wafers, field emission displays and other substrate-like structures either before or after forming components on the microelectronic devices. Many specific details of the invention are described below with reference to rotary planarizing applications to provide a thorough understanding of such embodiments. The present invention, however, can be practiced using web-format planarizing machines. A person skilled in the art will thus understand that the invention may have additional embodiments, or that the invention may be practiced without several of the details described below.

Figure 2A:
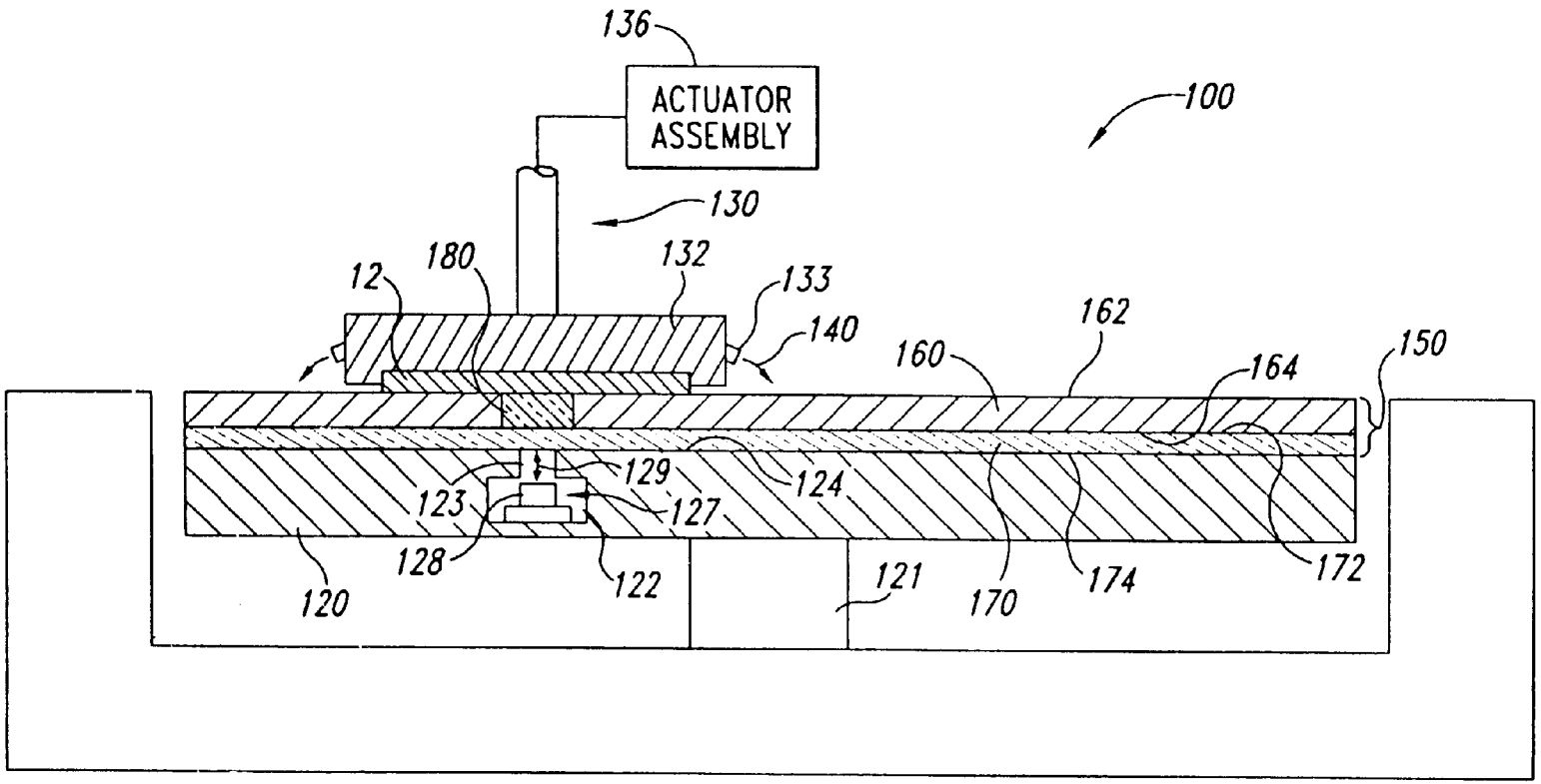
FIG. 2A is a schematic cross-sectional view of a rotary planarizing machine and a planarizing pad in accordance with an embodiment of the invention.

FIG. 2A is a schematic cross-sectional view of a planarizing machine 100 and a planarizing pad 150 in accordance with one embodiment of the invention. The planarizing machine 100 of this embodiment also includes a table or platen 120 coupled to a drive mechanism 121 that rotates the platen 120. The platen 120 can include a cavity 122 having an opening 123 at a support surface 124 of the platen 120. An optical monitoring system 127 is attached to the platen 120 in the cavity 122. The optical monitoring system 127 can include an optical emitter/receiver 128 that projects a light to beam 129 through the opening 123. The optical emitter/sensor 128 can be a reflectance device that emits the light beam 129 and senses a reflectance to determine the surface condition of the substrate 12 in-situ and in real time. Reflectance and interferometer endpoint sensors that may be suitable for the optical emitter/sensor 108 are disclosed in U.S. Pat. Nos. 5,865,665; 5,648,847; 5,337,144; 5,777,739; 5,663,797; 5,465,154; 5,461,007; 5,433,651; 5,413,941; 5,369,488; 5,324,381; 5,220,405; 5,717,255; 4,660,980; 4,640,002; 4,422,764; 4,377,028; 5,081,796; 4,367,044; 4,358,338; 4,203,799; and 4,200,395; and U.S. application Ser. Nos. 09/066,044 and 09/300,358; all of which are herein incorporated in their entirety by reference.

Figure 1:
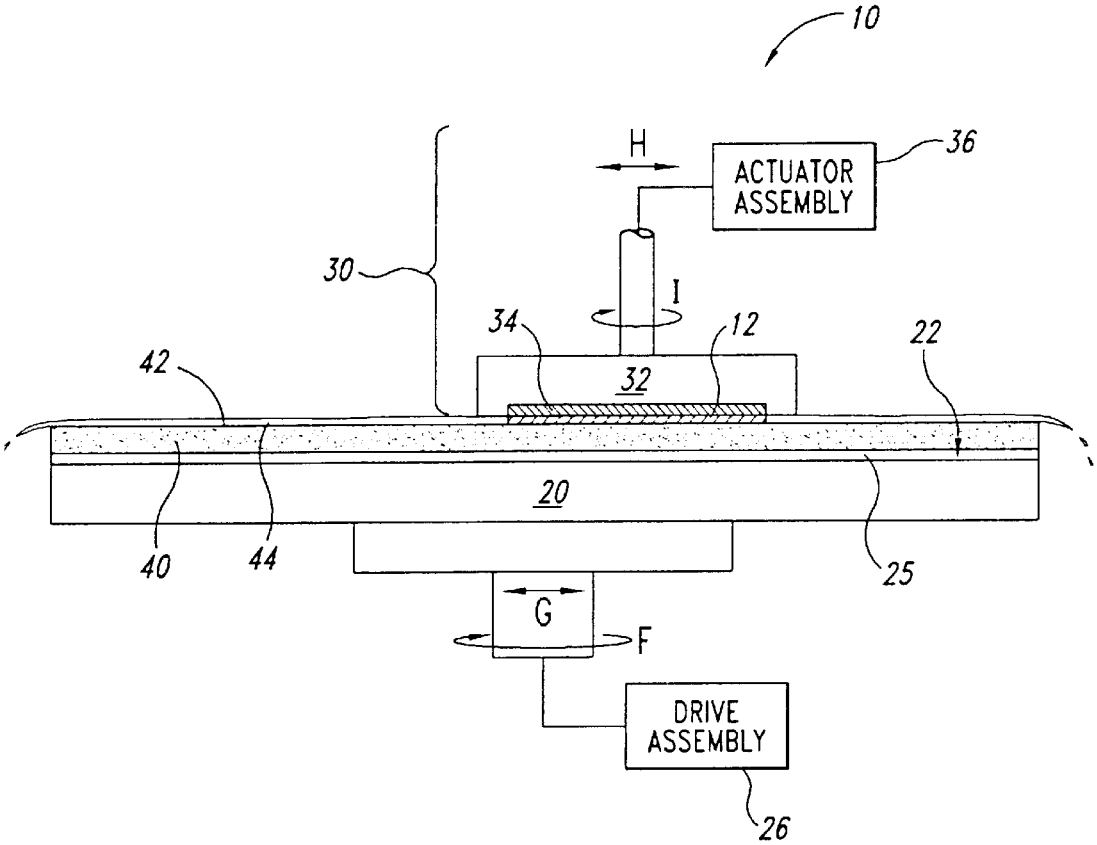
Fig. 1 (Prior Art)

The planarizing machine 100 can also include a carrier assembly 130 30 having a head 132 coupled to a drive mechanism 136. The head 132 holds and controls a substrate assembly 12 during a planarizing cycle. The head 132 can also include a number of nozzles 133 for dispensing a planarizing solution 140 onto the planarizing pad 150. The carrier assembly 130 can be substantially the same as the carrier assembly 30 described above with reference to FIG. 1.

The planarizing pad 150 in this embodiment has a planarizing medium 160, a backing member 170, and a lens or optically transmissive window 180. The planarizing medium 160 can be an abrasive or a non-abrasive body having a planarizing surface 162 and a backside 164. For example, an abrasive planarizing medium 160 can have a resin binder and a plurality of abrasive particles fixedly attached to the resin binder. Suitable abrasive planarizing mediums 151 are disclosed in U.S. Pat. Nos. 5,645,471; 5,879,222; and 5,624,303; and U.S. patent application Ser. Nos. 09/164,916 and 09/001,333; all of which are herein incorporated in their entirety by reference.

In this embodiment, the backing member 170 is an optically transmissive sheet having a top surface 172 and a bottom surface 174. The top surface 172 is adhered to the backside 164 of the planarizing medium 160, and the bottom surface 174 is adhered to the support surface 124 of the platen 120. The backing member 170, for example, can be a continuous sheet of polyester (e.g., optically transmissive Mylar®) or polycarbonate (e.g., Lexan®). The backing member 170 in this embodiment preferably transmits a sufficient amount of the light beam 129 to the window 180. In one particular embodiment of the planarizing pad 150, the planarizing medium 151 is an abrasive material having fixed-abrasive particles and the backing member 170 is a continuous sheet of optically transmissive Lexan®.

Figure 2B:
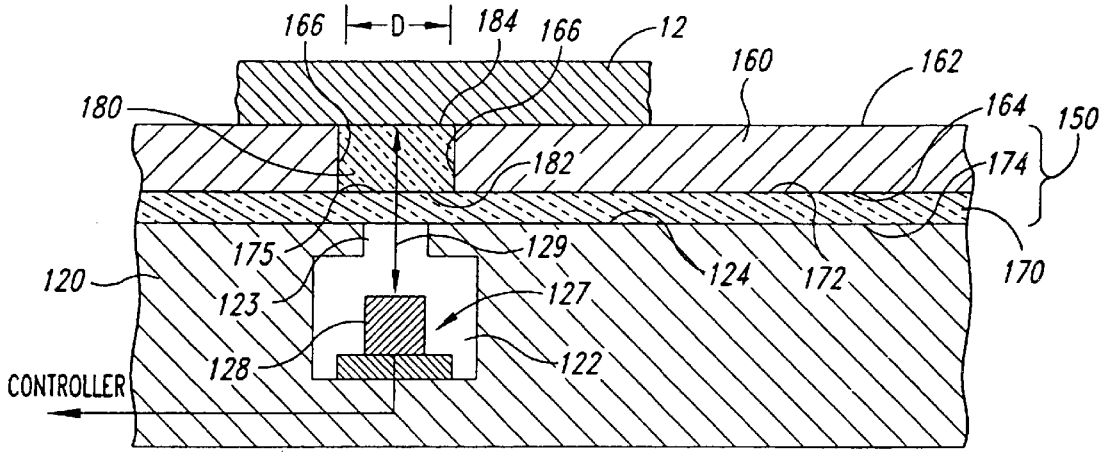
FIG. 2B is a schematic cross-sectional view of a portion of the planarizing machine and the planarizing pad of FIG. 2A.

FIG. 2B is a partial schematic cross-sectional view further illustrating the planarizing pad 150 in greater detail. The planarizing medium 160 further includes a hole 166 defined by sidewalls extending transversely to the backside 162 and the planarizing surface 164. The term "transverse" includes all non-parallel configurations and is not limited to perpendicular arrangements. The hole 166 can be a circular hole having a diameter D less than 10.0 mm, and more preferably less than approximately 2 mm. The window 180 also preferably abuts the sidewalls of the hole 166. The window 180 also 30 preferably has an interface or contact surface 182 coplanar with the backside 162 of the planarizing medium 160 and a top surface 184 coplanar with the planarizing surface 164. The backing member 170 has an exposed section 175 that extends from the sidewall of the hole 166 and preferably spans completely across the hole 166 under the contact surface 182 of the window 180. The window 180 can be attached to the backing member 170 by an adhesive along a seal path defined by the interface between the exposed section 175 of the backing member 170 and the contact surface 182 of the window 180.

The backing member 170 and the window 180 are preferably selected to provide the desired optical planarizing properties, planarizing characteristics, and durability. In this embodiment, the backing member 170 and the window 180 are thus separate, discrete components comprising optically transmissive materials. The backing member 170, for example, can comprise a highly durable material having (a) a desired hardness/compressibility to act as a typical backing pad and (b) the desired optical properties so that the light beam 129 can pass through the backing member 170. The window 180 is preferably selected to have good optical properties and a top surface 184 that does not impact the characteristics of the planarizing surface 164. The window 180, for example, can comprise glass, acrylic, clear polycarbonate or other suitable materials. In one particular application, the window 180 can comprise a diamond pane that resists scratching so that abrasive particles in the planarizing solution do not alter the optical properties of the window 180.

The embodiment of the planarizing pad 150 illustrated in FIGS. 2A and 2B is expected to enhance the flexibility in designing planarizing pads with windows to meet the needs of particular CMP applications. One feature of this embodiment of the planarizing pad 150 is that the backing member 170 and the window 180 are discrete components that can be made from different materials. As such, the backing member 170 can be selected to meet the requirements of typical backing pads, and the window 180 can be selected to meet separate optical and planarizing requirements. The particular materials of the backing member 170 and the window 180 can accordingly be selected to optimize the planarizing pad 150 for particular planarizing applications.

Figure 3:
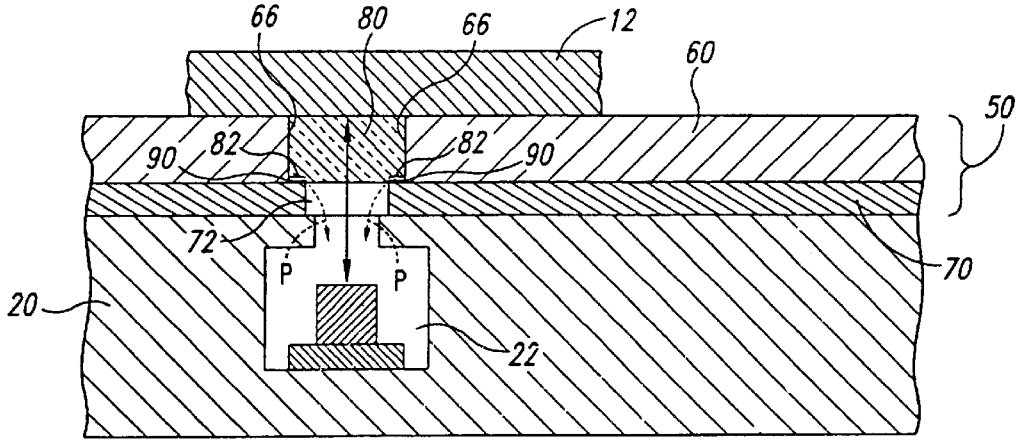
Fig. 3 (Prior Art)
FIG. 3 is a partially schematic cross-sectional view of a planarizing pad similar to the planarizing pad used in the Mirra® planarizing system.

The embodiment of the planarizing pad 150 shown in FIGS. 2A and 2B is also expected to reduce or even eliminate leaks that allow the planarizing solution to get underneath the planarizing pad 150. The planarizing solution can seep between the window 180 and the sidewalls of the hole 166, but the backing member 170 prevents the planarizing solution from leaking onto the platen 120 because it provides a continuous barrier that is impervious to the planarizing solution. This is expected to provide a substantial improvement in resisting leaks compared to conventional planarizing pads with windows, such as the planarizing pad 50 shown in FIG. 3. More particularly, the conventional planarizing pad 50 shown in FIG. 3 has a planarizing medium 60, a backing member 70 with an optical hole 72, and a window 80 having contact surfaces 82 attached to a small section of the backing member 70 by an adhesive 90. The conventional planarizing pad 50 shown in FIG. 3 is subject to leaking because the planarizing solution can seep through the adhesive 90 and flow through the backing member 170 (shown by the broken-line arrows P-P). The planarizing pad 150 shown in FIG. 2B is not susceptible to such leaking because the backing member 170 spans completely across the hole 166 in the planarizing medium 160, and thus it is expected to prevent the planarizing solution from flowing onto the platen 120.

Figure 4:
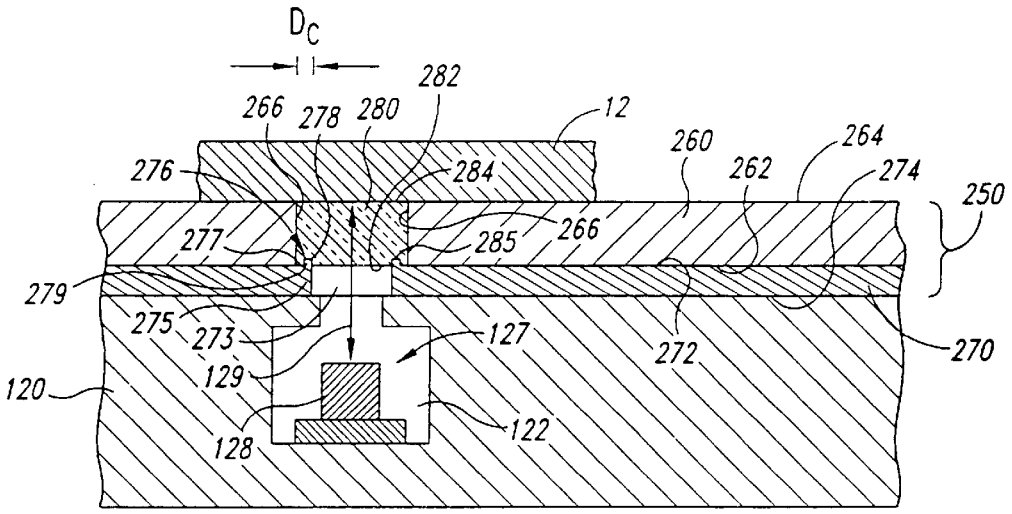
FIG. 4 is a partially schematic cross-sectional view of a planarizing machine and another planarizing pad in accordance with another embodiment of the invention.

FIG. 4 is a schematic cross-sectional view of a planarizing pad 250 on the platen 120 in accordance with another embodiment of the invention. The planarizing pad 250 has a planarizing medium 260 with a backside 262, a planarizing surface 264, and a hole 266 that can be substantially similar to the planarizing medium 160 described above. The planarizing pad 250 also includes a backing member 270 having a top surface 272 adhered to the backside 262 of the planarizing medium 260, and a bottom surface 274 adhered to the platen 120. The backing member 270 can further include a number of exposed sections or lateral sections 275 extending from the sidewalls of the hole 266 to project across a portion of the hole 266 by a cover distance DC measured normal to the sidewalls of the hole 266. In one embodiment, each exposed section 275 has a first segment 277 and a second segment 278 that together define an upper surface 276. The second segment 278 generally projects away from the first section 277 at an angle. The second segment 278 of the exposed section 275, for example, can define a lip 279 projecting normal to the first segment 277.

The exposed sections 275 are separated by an opening in the backing member 270. The opening 273 is aligned with the optical emitter/sensor 128 to allow a 30 light beam 129 to pass through the backing member 270. Therefore, the backing member 270 can comprise an opaque sheet or other materials that have limited optical transmitivity because these 273 provides an optical pathway for the light beam 129 to pass through the backing member 270. Suitable opaque materials include foamed polyurethane or other compressible foams, but in other embodiments the backing member 270 can comprise optically transmissive materials or generally incompressible materials.

The window 280 of the planarizing pad 250 can include a channel 285 configured to receive the second segment 278 of the exposed sections 275. The window 280 accordingly contacts the exposed sections 275 of the backing member 270 along an interface surface to define a seal path between the window 280 and the backing member 270. The seal path has a length greater than the cover distance D, because the interface between the lip 279 and the channel 285 increases the surface area that the window 280 contacts the backing member 270. The window 280 is accordingly adhered to the backing pad 270 along a non-planar, tortuous seal path to prevent or at least inhibit planarizing fluid (not shown) from leaking through the planarizing pad 250.

Figure 5:
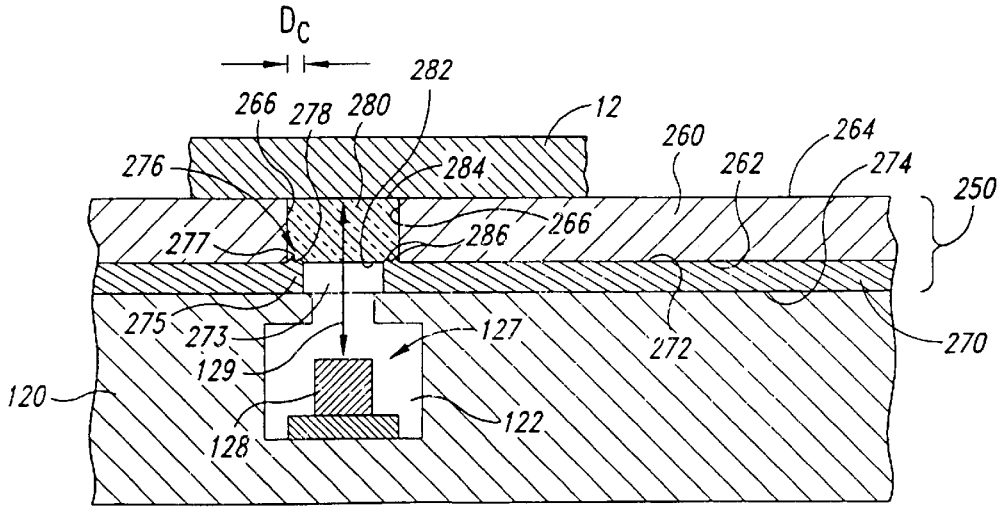
FIG. 5 is a partially schematic cross-sectional view of another planarizing machine and another planarizing pad in accordance with another embodiment of the invention.

FIG. 5 is a partial schematic cross-sectional view of another embodiment of the planarizing pad 250 in which the first and second segments 277 and 278 of the exposed sections 275 are separate ridges that mate with grooves 286 in the bottom of the window 280. The window 280 can accordingly be attached to the backing member 270 by an adhesive applied to the first and second segments 277 and 278 of the exposed sections 275. The other features of the embodiment of the planarizing pad 250 shown in FIG. 5 are the same as shown in FIG. 4. Thus, the window 280 in FIG. 5 is also adhered to the backing member 270 along a non-planar, tortuous seal path.

The embodiments of the planarizing pad 250 illustrated in FIGS. 4 and 5 are expected to reduce leaking of planarizing solution compared to the conventional planarizing pad 50 illustrated in FIG. 3. The planarizing pad 250 is expected to inhibit or eliminate the planarizing solution from leaking onto the platen because the seal path between the window 280 and the backing member 270 is a tortuous path having a length greater than the cover distance $D_c$. As such, the planarizing solution must not only pass through more adhesive in the planarizing pad 250 than the planarizing pad 50, but the planarizing solution must also travel through a torturous path in the planarizing pad 250 that further inhibits the planarizing solution from leaking through the planarizing pad 250.

The planarizing pad 250 also provides enhanced design flexibility because the backing member 270 can be made from materials that have a desired compressibility or other properties without necessarily being an optically transmissive material. Therefore, the planarizing pad 250 is expected to be suitable for applications that require particular properties that are not available in optically transmissive materials.

Figure 6:
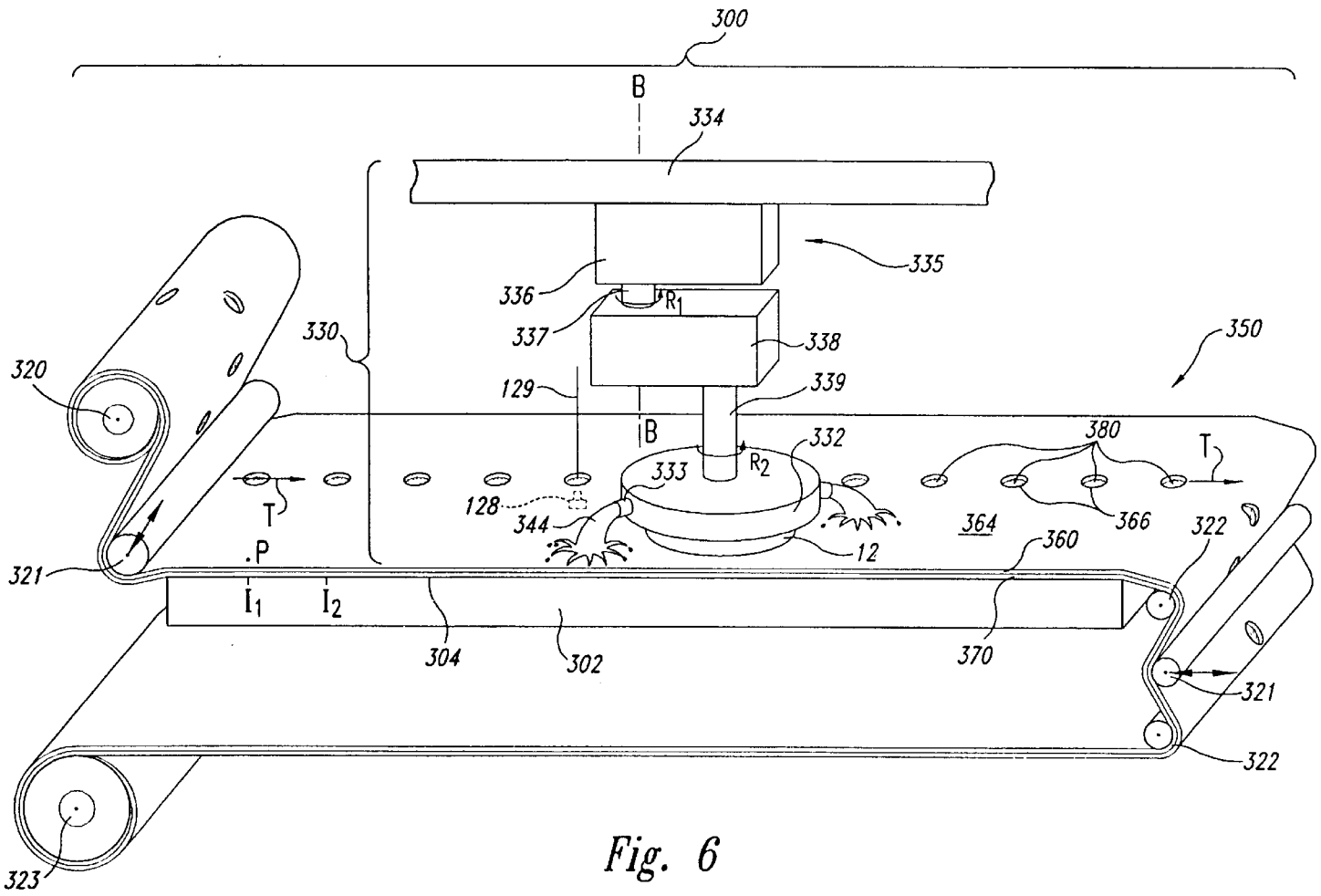
FIG. 6 is a partially schematic isometric view of a web-format planarizing machine in accordance with an embodiment of the invention.

FIG. 6 is a partially schematic isometric view of a web-format planarizing machine 300 in accordance with another embodiment of the invention. The planarizing machine 300 has a support table 302 with a top panel 304 at a work station where an operative portion of a web-format planarizing pad 350 is positioned. The top panel 304 is generally a rigid plate that provides a flat, solid surface to which a particular section of the planarizing pad 350 may be secured during planarization.

The planarizing machine 300 also has a plurality of rollers to guide, position and hold the planarizing pad 350 over the top panel 304. The rollers can include a supply roller 320, idler rollers 321, guide rollers 322, and a take-up roller 323. The supply roller 320 carries an unused or pre-operative portion of the planarizing pad 350, and a take-up roller 323 carries a used or post-operative portion of the planarizing pad 350. Additionally, the left idler roller 321 and the upper guide roller 322 stretch the planarizing pad 350 over the top panel 304 to hold the planarizing pad 350 stationary during operation. A motor (not shown) generally drives the take-up roller 323 to sequentially advance the planarizing pad 350 across the top panel 304 along a pad travel path T—T, and the motor can also drive the supply roller 320. Accordingly, a clean pre-operative section of the planarizing pad 350 may be quickly substituted for a used section to provide a consistent surface for planarizing and/or cleaning the substrate 12.

The web-format planarizing machine 300 also includes a carrier assembly 330 that controls and protects the substrate 12 during planarization. The carrier assembly 330 generally has a substrate holder 332 to pick up, hold and release the substrate 12 at appropriate stages of the planarizing cycle. Several nozzles 333 project from the substrate holder 332 to dispense a planarizing solution onto the planarizing pad 350. The carrier assembly 330 also generally has a support gantry 334 carrying a drive assembly 335 that can translate along the gantry 334. The drive assembly 335 generally has an actuator 336, a drive shaft 337 coupled to the actuator 336, and an arm 338 projecting from the drive shaft 337. The arm 338 carries the substrate holder 332 via a terminal shaft 339 such that the drive assembly 335 orbits the substrate holder 332 about an axis B—B (arrow $R_1$). The terminal shaft 339 may also be coupled to the actuator 336 to rotate the substrate holder 332 about its central axis C—C (arrow $R_2$).

The planarizing pad 350 shown in FIG. 6 is similar to the planarizing pad 150 shown in FIGS. 2A and 2B. The planarizing pad 350 can accordingly include a planarizing medium 360 having a plurality of holes 366 arranged in a line generally parallel to the pad travel path T—T. The planarizing pad 350 can also include a plurality of windows 380 in the holes 366 and a backing member 370 under the planarizing medium 360. The planarizing medium 360, the backing member 370 and the windows 380 can have any of the configurations illustrated above in FIGS. 2B, 4 and 5. The planarizing pad 350, therefore, provides a web-format planarizing pad that prevents the planarizing solution 344 from leaking through the holes 366.

The planarizing machine 300 can also include an optical emitter/sensor 128 (shown in the broken lines) attached to the table 302 at an illumination site aligned with the line of windows 380. In operation, the carrier assembly 330 preferably lowers the substrate 12 against the planarizing medium 360 and orbits the carrier head 332 about the axis B—B to rub the substrate 12 against the planarizing medium 360. The optical emitter/sensor 128 emits a light beam 129 that passes through a window 380 aligned with the illumination site to optically monitor the status of the substrate 12 during the planarizing cycle. The web-format planarizing machine 300 and the planarizing pad 350 are expected to provide the same advantages as the planarizing pads 150 and 250 described above.

From the foregoing, it will be appreciated that specific embodiments of the invention have been described herein for purposes of illustration, but that various modifications may be made without deviating from the spirit and scope of the invention. The backing member and window, for example, can comprise different materials than those described above to optimize the planarizing pad for the particular optical, planarizing, durability and hardness/compressibility requirements of a particular application. Accordingly, the invention is not limited except as by the appended claims.

What is claimed is:

1. A planarizing pad for planarizing a microelectronic substrate in mechanical and/or chemical-mechanical planarizing processes, comprising:

a planarizing medium having a planarizing surface, a backside opposite the planarizing surface and at least one hole extending from the planarizing surface to the backside, the hole having a sidewall transverse to the backside;

a backing member having a top surface attached to the backside of the planarizing medium and an exposed section extending from the sidewall to either span completely across the hole or to project across a portion of the hole for a cover distance normal to the sidewall; and a window in the hole, the window having an interface surface contacting the exposed section of the backing member along a seal path either spanning completely across the hole or having a length greater than the cover distance.

2. The pad of claim 1 wherein the backing member comprises an optically transmissive sheet spanning completely across the hole at the backside of the planarizing medium.

3. The pad of claim 2 wherein the backing member comprises a polycarbonate sheet.

4. The pad of claim 2 wherein the backing member comprises a polyester sheet.

5. The pad of claim 1 wherein:

the exposed section of the backing member extends across only a portion of the hole at the backside of the planarizing medium, the exposed section having a first segment and a second segment proyecting from the first segment, the first and second segments defining an upper surface of the exposed section; and the interface surface of the window contacts the upper surface defined by the first and second segments of the exposed section.

6. The pad of claim 1 wherein:

the exposed section of the backing member extends across only a portion of the hole at the backside of the planarizing medium, and the exposed section has an upwardly projecting lip; and the interface surface of the window receives the lip to define a non-planar seal path.

7. The pad of claim 1 wherein the backing member comprises a Mylar sheet and the window comprises glass.

8. The pad of claim 1 wherein the backing member comprises a Mylar sheet and the window comprises Lexan.

9. The pad of claim 1 wherein the backing member comprises a Mylar sheet and the window comprises an optical diamond piece.

10. The pad of claim 1 wherein the window comprises a polish material suitable for contacting the microelectronic substrate during a planarizing cycle.

11. The pad of claim 1 wherein the backing member comprises a compressible sheet and the window comprises glass.

12. The pad of claim 1 wherein the backing member comprises a compressible sheet and the window comprises Lexan.

13. The pad of claim 1 wherein the backing member comprises a compressible sheet and the window comprises an optical diamond piece.

14. The pad of claim 1 wherein the backing member comprises an incompressible sheet and the window comprises glass.

15. The pad of claim 1 wherein the backing member comprises an incompressible sheet and the window comprises Lexan.

16. The pad of claim 1 wherein the backing member comprises an incompressible sheet and the window comprises an optical diamond piece.

17. A planarizing pad for planarizing a microelectronic substrate in mechanical and/or chemical-mechanical planarizing processes, comprising:

a planarizing medium having a planarizing surface, a backside opposite the planarizing surface and at least one hole extending from the planarizing surface to the backside, the hole having a sidewall transverse to the backside;

a backing member having a top surface attached to the backside of the planarizing medium and an exposed section extending from the sidewall to project across a portion of the hole, the exposed section having a first segment and a second segment at an angle to the first segment, the first and second segments defining a non-planar upper surface on the exposed section; and a window in the hole, the window having an interface surface contacting the upper surface of the first and second segments of the exposed section.

18. The pad of claim 17 wherein the backing member comprises a compressible sheet and the window comprises glass.

19. The pad of claim 17 wherein the backing member comprises a compressible sheet and the window comprises Lexan.

20. The pad of claim 17 wherein the backing member comprises a compressible sheet and the window comprises an optical diamond piece.

21. The pad of claim 17 wherein the backing member comprises an incompressible sheet and the window comprises glass.

22. The pad of claim 17 wherein the backing member comprises an incompressible sheet and the window comprises Lexan.

23. The pad of claim 17 wherein the backing member comprises an incompressible sheet and the window comprises an optical diamond piece.

24. The pad of claim 17 wherein the second segment is not co-planar with the first segment.

25. A planarizing pad for planarizing a microelectronic substrate in mechanical and/or chemical-mechanical planarizing processes, comprising:

a planarizing medium having a planarizing surface, a backside opposite the planarizing surface, and at least one hole extending from the planarizing surface to the backside;

an optically transmissive window in the hole, the window having a bottom surface; and an optically transmissive backing member having a top surface attached to the backside of the planarizing medium and a contact surface spanning completely across the hole and facing the bottom surface of the window, wherein the backing member and the window are discrete components.

26. The pad of claim 25 wherein the backing member comprises a polycarbonate sheet.

27. The pad of claim 25 wherein the backing member comprises a polyester sheet.

28. The pad of claim 25 wherein the backing member comprises a polycarbonate sheet and the window comprises glass.

29. The pad of claim 25 wherein the backing member comprises a polycarbonate sheet and the window comprises Lexan.

30. The pad of claim 25 wherein the backing member comprises a polycarbonate sheet and the window comprises an optical diamond piece.

31. The pad of claim 25 wherein the backing member comprises a compressible sheet and the window comprises glass.

32. The pad of claim 25 wherein the backing member comprises a compressible sheet and the window comprises Lexan.

33. The pad of claim 25 wherein the backing member comprises a compressible sheet and the window comprises an optical diamond piece.

34. The pad of claim 25 wherein the backing member comprises an incompressible sheet and the window comprises glass.

35. The pad of claim 25 wherein the backing member comprises an incompressible sheet and the window comprises Lexan.

36. The pad of claim 25 wherein the backing member comprises an incompressible sheet and the window comprises an optical diamond piece.

37. A planarizing pad for planarizing a microelectronic substrate in mechanical and/or chemical-mechanical planarizing processes, comprising:

a planarizing medium having a planarizing surface, a backside opposite the planarizing surface, and at least one hole extending from the planarizing surface to the backside, the hole having a sidewall transverse to the planarizing surface;

a backing member attached to the backside of the planarizing medium, the backing member having a lateral section projecting from the sidewall along the backside of the planarizing medium across a portion of the hole for a cover distance normal to the sidewall, and the backing member having a lip projecting from the lateral section; and a window in the hole, the window having a channel receiving the lip of the backing member.

38. A planarizing machine for mechanical and/or chemical-mechanical planarization of microelectronic substrates, comprising:

a table having a support surface and an opening at an illumination site;

an optical monitoring system having a light source and an optical sensor, the monitoring system being aligned with the opening in the table to direct a light beam through the opening;

a planarizing pad coupled to the support surface of the table, the pad comprising a planarizing medium, a backing member attached to the planarizing medium, and a window in the planarizing medium, wherein the planarizing medium has a planarizing surface, a backside opposite the planarizing surface and at least one hole extending from the planarizing surface to the backside, the hole having a sidewall transverse to the backside, wherein the backing member has a top surface attached to the backside of the planarizing medium and an exposed section extending from the sidewall to either span completely across the hole or to project across a portion of the hole for a cover distance normal to the sidewall, and wherein the window is in the hole and the window has an interface surface contacting the exposed section of the backing member along a seal path either spanning completely across the hole or extending along a length greater than the cover distance; and a carrier assembly having a head for holding a substrate assembly and a drive mechanism connected to the head, the drive mechanism controlling the head to move the substrate assembly with respect to the planarizing pad.

39. The planarizing machine of claim 38 wherein the backing member comprises an optically transmissive sheet spanning completely across the hole at the backside of the planarizing medium.

40. The planarizing machine of claim 38 wherein the backing member comprises a polycarbonate sheet.

41. The planarizing machine of claim 38 wherein the backing member comprises a polyester sheet.

42. The planarizing machine of claim 38 wherein:

the exposed section of the backing member extends across only a portion of the hole at the backside of the planarizing medium, the exposed section having a first segment and a second segment projecting from the first segment, the first and second segments defining an upper surface of the exposed section; and the interface surface of the window contacts the upper surface defined by the first and second segments of the exposed section.

43. The planarizing machine of claim 38 wherein:

the exposed section of the backing member extends across only a portion of the hole at the backside of the planarizing medium, and the exposed section has an upwardly projecting lip; and the interface surface of the window receives the lip to define a non-planar seal path.

44. The planarizing machine of claim 38 wherein:

the exposed section of the backing member extends across only a portion of the hole at the backside of the planarizing medium, and the exposed section has a downwardly projecting lip; and the interface window receives the lip to define a non-planar seal path.

45. A planarizing machine for mechanical and/or chemical-mechanical planarization of microelectronic substrates, comprising:

a table having a support surface and an opening at an illumination site;

an optical monitoring system having a light source and an optical sensor, the monitoring system being aligned with the opening in the table to direct a light beam through the opening;

a planarizing pad coupled to the support surface of the table, the pad comprising a planarizing medium, an optically transmissive window in the planarizing medium, and an optically transmissive backing member attached to the planarizing medium, wherein the planarizing medium has a planarizing surface, a backside opposite the planarizing surface, and at least one hole extending from the planarizing surface to the backside, wherein the optically transmissive window is in the hole and the window has a bottom surface, and wherein the optically transmissive backing member has a top surface attached to the backside of the planarizing medium and a contact surface spanning completely across the hole to face the bottom surface of the window, the backing member and the window being discrete components; and a carrier assembly having a head for holding a substrate assembly and a drive mechanism connected to the head, the drive mechanism controlling the head to move the substrate assembly with respect to the planarizing pad.

46. The planarizing machine of claim 45 wherein the backing member comprises a polycarbonate sheet.

47. The planarizing machine of claim 45 wherein the backing member comprises a polyester sheet.

48. The planarizing machine of claim 45 wherein the backing member comprises a polycarbonate sheet and the window comprises glass.

49. The planarizing machine of claim 45 wherein the backing member comprises a polycarbonate sheet and the window comprises Lexan.

50. The planarizing machine of claim 45 wherein the backing member comprises a polycarbonate sheet and the window comprises an optical diamond piece.

51. A planarizing machine for mechanical and/or chemical-mechanical planarization of microelectronic substrates, comprising:

a table having a support surface and an opening at an illumination site;

an optical monitoring system having a light source and an optical sensor, the monitoring system being aligned with the opening in the table to direct a light beam through the opening;

a planarizing pad coupled to the support surface of the table, the pad comprising a planarizing medium, a backing member attached to the planarizing medium, and a window in the planarizing medium, wherein the planarizing medium has a planarizing surface, a backside opposite the planarizing surface, and at least one hole extending from the planarizing surface to the backside, the hole having a sidewall transverse to the planarizing surface, wherein the backing member is attached to the backside of the planarizing medium, and the backing member has an exposed lateral section projecting from the sidewall along the backside of the planarizing medium across a portion of the hole for a cover distance normal to the sidewall and the exposed lateral section has a lip, and wherein the window is in the hole and the window has a channel receiving the lip of the exposed lateral section; and a carrier assembly having a head for holding a subtrate assembly and a drive mechanism connected to the head, the drive mechanism controlling the head to move the substrate assembly with respect to the planarizing pad.

52. The planarizing machine of claim 51 wherein the backing member comprises a Mylar sheet and the window comprises glass.

53. The planarizing machine of claim 51 wherein the backing member comprises a Mylar sheet and the window comprises Lexan.

54. The planarizing machine of claim 51 wherein the backing member comprises a Mylar sheet and the window comprises an optical diamond piece.

55. The planarizing machine of claim 51 wherein the backing member comprises a compressible sheet and the window comprises glass.

56. The planarizing machine of claim 51 wherein the backing member comprises a compressible sheet and the window comprises Lexan.

57. The planarizing machine of claim 51 wherein the backing member comprises a compressible sheet and the window comprises an optical diamond piece.

58. The planarizing machine of claim 51 wherein the backing member comprises an incompressible sheet and the window comprises glass.

59. The planarizing machine of claim 51 wherein the backing member comprises an incompressible sheet and the window comprises Lexan.

60. The planarizing machine of claim 51 wherein the backing member comprises an incompressible sheet and the window comprises an optical diamond piece.

61. A method for manufacturing a planarizing pad used in mechanical and/or chemical-mechanical planarization of microelectronic substrates, comprising:

forming a hole in a planarizing medium, the hole having a sidewall extending transverse to a backside of the planarizing medium;

attaching a top surface of a backing member to the backside of the planarizing medium so that an exposed section of the backing member extends from the sidewall to either span completely across the hole or to project across a portion of the hole for a cover distance normal to the sidewall;

inserting an optical window into the hole; and sealing the optical window and the exposed section of the backing member together along a seal path extending either completely across the hole or along a length greater than the cover distance.

62. A method of planarizing a microelectronic substrate assembly, comprising:

removing material from a microelectronic substrate by pressing the substrate against a planarizing medium of a planarizing pad and moving the substrate and/or the planarizing pad to rub the substrate and the pad against each other;

monitoring the microelectronic substrate during a planarizing cycle by projecting a light beam from an optical emitter through a window in the planarizing medium and through a backing pad attached to the planarizing medium, and sensing a reflection of the light beam from the substrate; and inhibiting a planarizing fluid from leaking through the planarizing pad adjacent to the window by providing a seal between the window and an exposed section of the backing member along a seal path extending either completely across the hole or along a tortuous path between the window and the backing pad.

* * * * *

UNITED STATES PATENT AND TRADEMARK OFFICE

CERTIFICATE OF CORRECTION

PATENT NO. : 6,428,386 B1
DATED : August 6, 2002
INVENTOR(S) : A. Bartlett

It is certified that error appears in the above-identified patent and that said Letters Patent is hereby corrected as shown below:

Column 2,
Line 37, “sabstrate” should be -- substrate --;
Line 66, “oral” should be -- optical --;

Column 3,
Line 41, “o” should be -- of the --;
Line 63, delete “As”;

Column 4,
Line 44, delete “to” between “light” and “beam”;

Column 5,
Line 35, delete “30” between “also” and “preferably”;

Column 6,
Line 48, “DC” should be -- $D_c$ --;
Line 62, “these” should be -- the hole --;

Column 8,
Lines 3 and 30, “T—T” should be -- *T—T* --;

Column 9,
Line 29, “proyecting” should be -- projecting --;

Column 13,
Line 41, “subtrate” should be -- substrate --;

Signed and Sealed this

Eighth Day of April, 2003

JAMES E. ROGAN
*Director of the United States Patent and Trademark Office*